United States Patent [19]

Biffle

[11] 4,441,551

[45] Apr. 10, 1984

[54] MODIFIED ROTATING HEAD ASSEMBLY FOR ROTATING BLOWOUT PREVENTORS

[76] Inventor: Morris S. Biffle, 800 W. Front, Midland, Tex. 79761

[21] Appl. No.: 311,793

[22] Filed: Oct. 15, 1981

[51] Int. Cl.[3] ..... E21B 33/06

[52] U.S. Cl. ..... 166/84; 251/1 B; 277/31; 175/195; 92/241

[58] Field of Search ..... 251/1 B, 1 R; 277/30, 277/31, 152, 153, 205, 212 R, 212 C; 166/84, 88; 175/195; 92/241, 254

[56] References Cited

U.S. PATENT DOCUMENTS

| | | | |
|---|---|---|---|
| 2,069,212 | 4/1935 | Buffington | 92/241 |
| 3,915,426 | 10/1975 | LeRouax | 251/1 B |
| 4,208,056 | 6/1980 | Biffle | 277/31 |
| 4,361,185 | 11/1982 | Biffle | 277/31 X |

*Primary Examiner*—Martin P. Schwadron
*Assistant Examiner*—Sheri Novack
*Attorney, Agent, or Firm*—Marcus L. Bates

[57] ABSTRACT

Improvements in the rotating head assembly of a rotating blowout preventor. The rotating head assembly includes a stripper rubber which has an upper annular area attached to the lower annular end of a metal support member. The support member extends upwardly into fixed relationship respective to part of the rotating head. The stripper rubber downwardly depends into concentrically arranged, spaced annular body members. The inner annular body has an axial passageway formed therethrough for telescopingly receiving a rotating member in sealed relationship therewith. The outer annular member has an outer circumferentially extending wall surface which rotatably engages the lower marginal end of a fixed washpipe. The inner and outer annular members are made integral respective to the upper annular area of the stripper rubber, and are separated from one another by a downwardly opening annular recess. A cylindrical control sleeve is vulcanized within the outer annular member to control the deformation of the outer peripheral wall surface which engages the inner wall surface of the washpipe.

17 Claims, 9 Drawing Figures

MODIFIED ROTATING HEAD ASSEMBLY FOR ROTATING BLOWOUT PREVENTORS

BACKGROUND OF THE INVENTION

In U.S. Pat. Nos. 4,154,448 and 4,208,056, there is set forth a rotating blowout preventor, hereinafter called a RBOP, which includes a washpipe rigidly affixed to a main body, with there being a bearing housing located externally of the washpipe for rotatably supporting a rotating head assembly. The rotating head assembly includes a removable stripper rubber assembly which is received within the washpipe and is clamped at the upper end of the rotating head assembly. The stripper rubber assembly accordingly is easily removed from the interior of the RBOP by merely unfastening the clamp means and lifting the stripper rubber assembly upwardly from the washpipe.

The above patented construction isolates the bearing housing from the returned drilling fluid. However, debris flowing uphole impact against the interface formed between the stripper rubber exterior and the washpipe interior. The debris continually and progressively accumulate, and eventually, the interior of the washpipe becomes unduly erroded. As this undesirable condition progresses, the debris eventually attack the rotating mechanical seal, accelerating the wear on the seal, until eventually the RBOP must be removed from service for repair. This condition is especially pronounced when drilling with compressible fluid, such as air or gas, because the debris can rebound several times as the axially flowing drilling fluid changes direction to flow through the lateral outlet passageway.

Accordingly, in patent application Ser. No. 202,686, now U.S. Pat. No. 4,361,185; RBOP has been provided with means by which the debris are deflected from an uphole axial direction into a lateral direction so that impact against the intervening area between the stripper rubber and the interior surface of the washpipe is precluded, thereby greatly reducing wear on some critical components of the RBOP. In U.S. Pat. No. 4,361,185 the lower marginal end of the rubber stripper has an inner annular member spaced from an outer annular member. The outer annular member has an outwardly biased skirt which sealingly engages the inner peripheral wall surface of the washpipe in order to protect the interface located therebetween from ingress of debris. The uphole or downhole thrust and various other forces which are exerted upon the stripper rubber causes the outer wall surface of the outer annular member to sometime unfavorably distort into an unsatisfactory configuration which accelerates the wear rate of the coacting parts. Accordingly, the reinforcement of the rubber in selected areas to provide control over this wear rate and to reduce the rate to a satisfactory value is the subject of this invention.

SUMMARY OF THE INVENTION

Improvements in a RBOP having a main body, a lateral outlet leading from said main body, means for attaching the main body to the upper end of a wellbore casing, and an axial passageway formed through said main body through which a rotating member, such as a kelly or a tool string, can be telescopingly received in sealed relationship therewith.

The main body includes an upwardly extending fixed washpipe rigidly attached thereto which forms a support member for a rotating head assembly. The rotating head assembly is rotatably mounted at the upper end of the main body and includes a stripper rubber assembly which is telescopingly and rotatably received in a removable manner within the interior of the washpipe. The stripper rubber assembly includes a rotating seal which sealingly engages the interior of the washpipe, thereby precluding fluid flow through the annulus formed between the stripper rubber assembly and the washpipe.

The stripper rubber assembly includes an upper metal support member to which there is attached a stripper rubber at the lower end thereof. The before mentioned axial passageway is formed through the member and through the stripper rubber. The stripper rubber has an upper annular end attached to the lower annular end of the metallic support member, with the lower end of the stripper rubber extending downwardly therefrom. The interior of the stripper rubber sealingly engages the rotating member which slidably extends therethrough.

The stripper rubber has a large, upper annular end which is attached to radially spaced, concentrically arranged, lower annular ends. The lower annular ends are made integrally with the upper end of the rubber and are comprised of an inner annular body and an outer annular body separated from one another by a dovnwardly opening annular recess. The inner annular body includes the before mentioned axial passageway, while the outer annular body includes an outer circumferentially extending surface which rotatably engages the lower inside marginal end of the washpipe in sealed relationship therewith.

The outer annular body includes a cylindrical, concentrically arranged control sleeve which is vulcanized therewithin. The control sleeve, which can take on several different forms, provides reinforcement to the rubber compound and prevents unsatisfactory distortion of the outer annular member. A renewable wear bushing forms the inner marginal wear surface of the washpipe at the area contacted by the outer annular body.

Accordingly, a primary object of the present invention is the provision of improvements in a RBOP by which wear at the interface formed between the stripper rubber and the washpipe is minimized.

Another object of the present invention is the provision of an improved stripper rubber assembly having a reinforced stripper rubber made into a configuration which controls the distortion of the rubber in selected areas.

A further object of this invention is the provision of an improved stripper rubber for RBOPs which have a lower outer configuration which protects the rubber, washpipe, and seals from excessive wear.

A still further object of this invention is the provision of a RBOP having a stripper rubber assembly which forms part of the rotating head assembly, and which is made into a configuration to reduce the wear rate of some of the coacting parts thereof.

Another and still further object of this invention is the provision of a stripper rubber assembly which is removably affixed to the rotating head of a RBOP, and which has a reinforced outer annular rubber part made into a particular configuration for decelerating the wear rate between the rubber and the washpipe.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the present disclosure.

DETAILED DESCRIPTION OF THE PREFERRED EMBODIMENT

Figure 1:
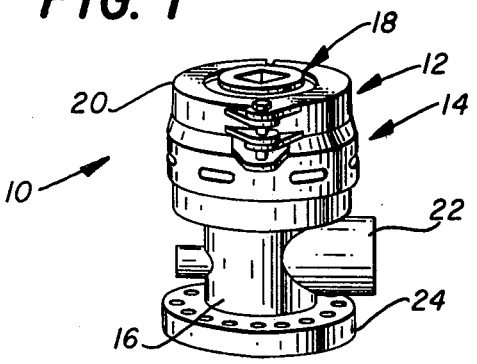
FIG. 1 is a perspective view of a RBOP having the present invention incorporated therewithin.

In the figures of the drawings, there is disclosed a RBOP 10 having a rotating head assembly 12 connected at the upper, marginal end thereof which has been modified in accordance with the present invention. The apparatus includes an external bearing housing 14, the details of which are more specifically set forth in my previous U.S. Pat. No. 4,154,448.

A main body 16 supports the head assembly. The upper end 18 of the RBOP drivingly receives a kelly 49 in a telescopingly manner axially therethrough. Clamp 20 removably affixes the rotating head assembly to the remaining rotating parts of the RBOP. Outlet pipe 22 conducts fluid flow away from the RBOP in the usual manner, while mounting flange 24 provides a means by which the RBOP can be secured to the upper terminal end of a cased wellbore.

Figure 2:
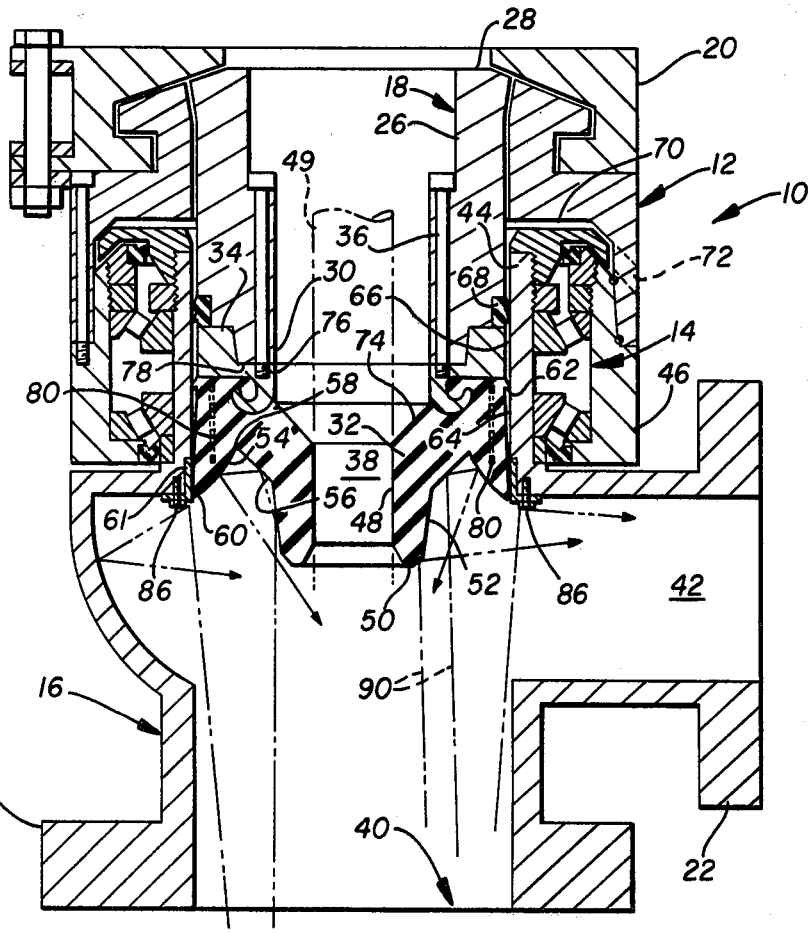
FIG. 2 is an enlarged, longitudinal, cross-sectional view of the apparatus disclosed in FIG. 1.

In FIG. 2, an annular mount 26 is mounted in fixed relationship respective to the remaining rotating parts of the head. The annular mount has a top 28 which cooperates with the before mentioned clamp 20 whereby the rotating head assembly is secured within the main body. Numeral 30 indicates the inner wall surface of the annular mount, which is reduced in diameter at the lower marginal end thereof for accommodating a rubber stripper 32.

A lower marginal end of a mounting ring 34 is vulcanized onto the upper marginal end of the rubber stripper. Bolts 36 removably affix the ring to the annular mount member. Passageway 38 is formed through the rubber stripper and is in communication with the main inlet passageway 40 which represents uphole flow from the borehole. Outlet 42 communicates with the main inlet passageway 40.

The upper marginal end of the main body is in the form of a fixed washpipe 44. Numeral 46 indicates the lower end of the external part of the rotating head assembly. Numeral 48 indicates the inside diameter of the axial passageway formed through the stripper rubber. The stripper rubber terminates at lower end 50.

The stripper rubber includes an inner annular part 52 spaced from an outer annular part 54, with there being a central wall 56 connecting the inner and outer annular parts together. Accordingly, a first wall 52 is connected to a third wall 56 by a second wall 54. The walls jointly form a downwardly opening annular area 58. The outer annular part terminates in a lower end 60 which is outwardly biased against a removable wear bushing 61, and forms a seal against the intrusion of debris, as will be more fully discussed later on in this disclosure.

An upper annular circumferentially extending barrier 62 may be included at the upper end of the stripper rubber to form a supplemental seal between the interior of the washpipe 44 and the outer surface of the stripper rubber assembly.

Annulus 64, 66, and 70 are spaced from one another and are formed by seal means 60, 62, and 68. Seal means 68 is a mechanical type seal which is removably mounted in captured relationship within the stripper rubber assembly. Radial port 72 communicates with annular bleed passageway 70 so that leakage is conducted away from the bearing housing 14.

The rubber may include an upper sloped face 74 against which there is received a wedge in accordance with my co-pending patent application Ser. No. 202,688. Fastener 76 maintains the rubber mount ring affixed to the annular mount member. Interface 78 is formed between the mount ring and the mount member.

Control sleeve 80, which can take on several different forms, preferably is cylindrical in form and of a configuration whereby it can be vulcanized into the outer annular member at a location to reinforce the rubber and control distortion of the outer surface of the outer annular member.

Figure 3:
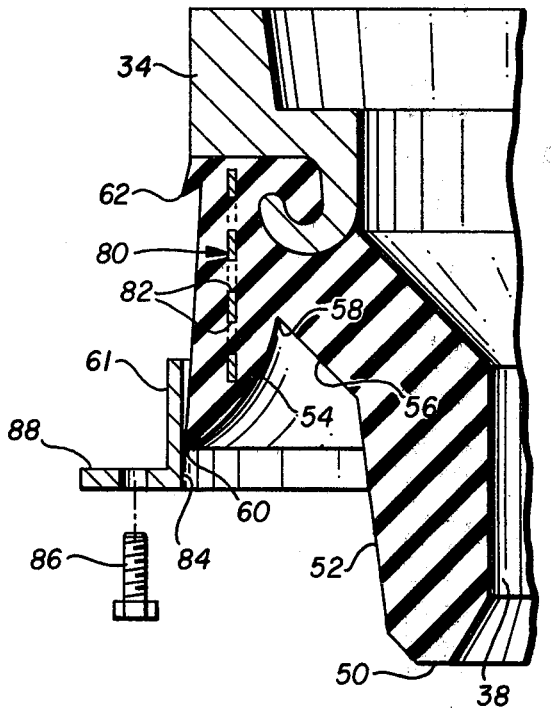
FIG. 3 is a fragmented, enlarged, cross-sectional view of part of the apparatus disclosed in FIG. 2.
Figure 4:
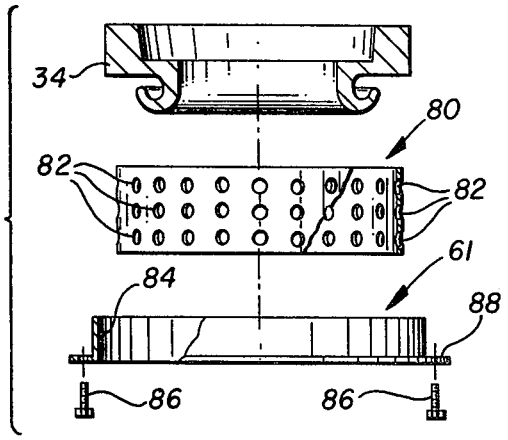
FIG. 4 is an exploded, part cross-sectional view of part of the apparatus disclosed in FIG. 3.

In FIGS. 3 and 4, the control sleeve is seen to be perforated at 82 in order to bond the parts together and to maintain the rubber body in the form of a unitary member. The control sleeve circumferentially extends 360° about the axial passageway 38 and is located within the outer annular member.

Figure 5:
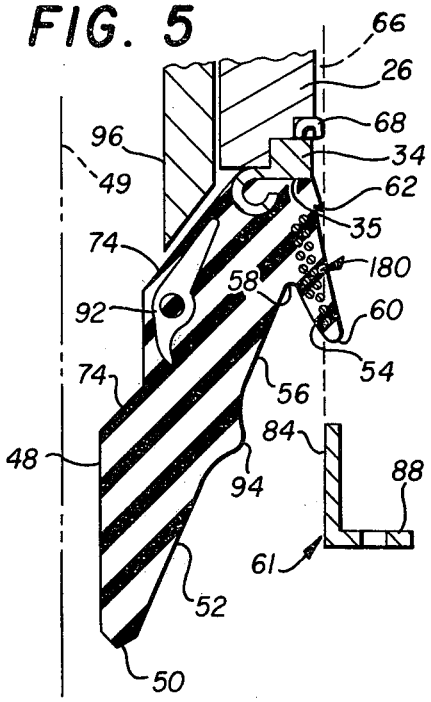
FIG. 5 is a fragmented, cross-sectional view similar in some respects to FIG. 3 which sets forth a modification of the present invention.
Figure 6:
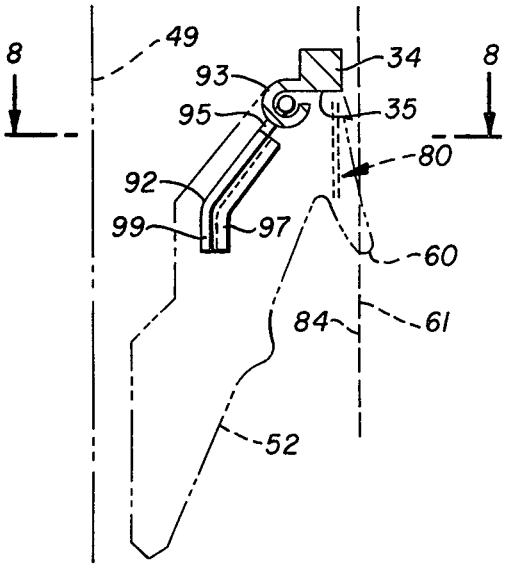
FIG. 6 is a part cross-sectional view of part of a RBOP made in accordance with the present invention.
Figure 7:
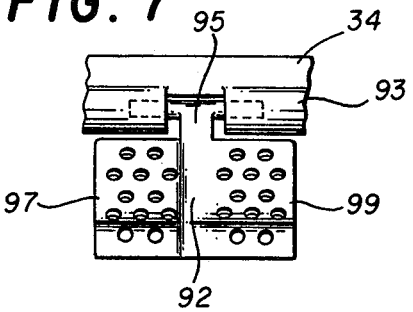
FIG. 7 is a fragmentary view of part of the apparatus disclosed in FIG. 6.

In FIGS. 3, 4 and 5, wear surface 84 of wear bushing 61 receives the lower marginal end 60 of the outer annular member sealingly biased there against. Fasteners 86 extend through flange 88 of the wear bushing, and provide a means by which the wear bushing can be removably attached to the washpipe.

In FIG. 5, the control sleeve 180 is in the form of a plurality of reinforcing cords. The cords preferably are similar to the cords of a tire thread, and can be selected from tire cord material, including filaments of synthetic and natural fibers, metal cords, fiberglass, as well as a composite of these materials.

Finger reinforcements 92 are included in the rubber, especially when wedge 96 is employed in accordance with the before mentioned patent application.

The control sleeve of the present invention causes the outer annular member to maintain the configuration seen illustrated in FIGS. 3 and 5, wherein the lower marginal end at 60 is biased against the washpipe. A rubber, in the absence of the present invention, will distort along the entire outer surface between 62 and 60, causing non-uniform and rapid wear.

In FIGS. 6–9, fingers 92 are vulcanized to the rubber and hinged to the outwardly opening annular member 93 by means of link 95. The link 95 is a T-bar having opposed ends received within the member 93, as noted in FIGS. 6 and 7. The fingers 92 of the embodiment set forth in FIGS. 6–9 include coacting overlapping marginal edges or sides 97 and 99 which circumferentially extend from the central body portion 92. The fingers cooperate together to form a curtain or barrier which prevents a high pressure differential across the rubber from causing extrusion or cold flowing of the rubber material.

Figure 8:
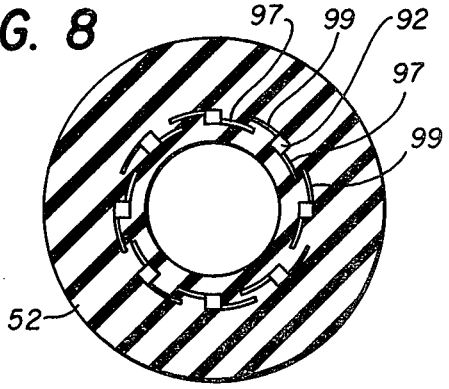
FIG. 8 is a cross-sectional view taken along lines 8—8 of FIG. 6; and, FIG. 9 is another cross-sectional view, similar to FIG. 8.
Figure 9:
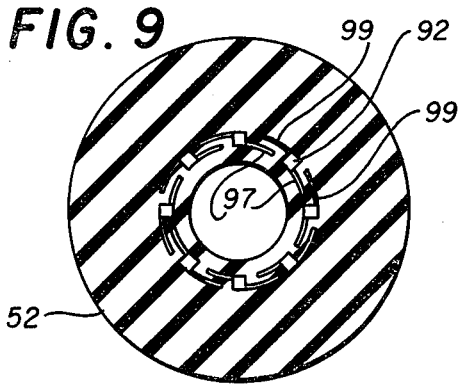

As seen in FIGS. 8 and 9, when a tool joint 49 is forced through the rubber, the individual vulcanized fingers expand from the configuration of FIG. 9 into the configuration of FIG. 8.

I claim:

1. A rotating blowout preventor having a main body; a lateral outlet leading from said main body, attachment means by which said main body can be connected to the upper end of a wellbore casing; an axial passageway formed through said main body through which a rotating member can be telescopingly received, said lateral passageway is in communication with said axial passageway;

an upwardly extending washpipe affixed to and forming part of said main body; a rotating head assembly rotatably mounted at the upper end of said main body, said rotating head assembly includes a stripper rubber assembly affixed thereto and positioned within said axial passageway; said stripper rubber assembly includes a stripper mount member and a stripper rubber; an axial passageway formed through said stripper assembly;

said stripper rubber has a large annular upper end attached to said mount member, and spaced, concentrically arranged, lower annular marginal ends; said lower annular marginal ends are comprised of an inner annular body and an outer annular body separated from one another by a downwardly opening annular recess; the last said axial passageway is formed through said inner annular body for sealingly receiving a rotating member in a telescoping manner therethrough; said outer annular body has an outer circumferentially extending surface which slidably and sealingly engages an inner peripheral wall surface of the washpipe;

said annular recess includes an upwardly and outwardly inclined first wall portion which forms a lower outer marginal end of said inner annular body, an upwardly and inwardly inclined second wall portion which forms a lower inner marginal end of said outer annular body, and a sloped third wall portion which lies at an obtuse angle respective to said first wall and at an acute angle respective to said second wall and connects said first and second wall portions together;

a control sleeve positioned within said outer annular body, said control sleeve is cylindrical in form and concentrically arranged respective to the axial passageway so that reinforcement is provided within the rubber compound to prevent undue distortion of the outer peripheral surface of the outer annular body.

2. The rotating blowout preventor of claim 1 wherein said control sleeve is comprised of a plurality of reinforcing cords vulcanized within the rubber which forms said outer annular body, said control sleeve extends from said outer annular body up into said large annular upper end of the stripper rubber.

3. The rotating blowout preventor of claim 2 wherein said large annular upper end of said stripper rubber enlarges in diameter is a downward direction; the inner surface area of said washpipe terminates adjacent to the lowermost outer surface area of the outer annular body of the stripper rubber, so that the lowermost outer surface area of the outer annular body and the inner surface area of the washpipe jointly cooperate to provide a rotating barrier near the lower end of said washpipe.

4. The rotating blowout preventor of claim 3 wherein said first wall surface is inclined at a small angle respective to the central axis of the stripper assembly, and said third wall surface is inclined at a greater angle relative to the first wall.

5. The rotating blowout preventor of claim 4 wherein said rotating head assembly is rotatably mounted to said main body by journal means located externally of said washpipe, with part of the rotating head assembly extending above said washpipe; a seat formed at the upper marginal end of said rotating assembly, the upper marginal end of said stripper assembly being received by said seat; and clamp means circumferentially extending about and holding the upper marginal end of said mount member to the remaining part of the rotating head assembly.

6. The rotating blowout preventor of claim 2 wherein said outer annular body of said stripper rubber has an outer surface area which enlarges in diameter in a downward direction, the inside surface area of said washpipe includes a wear sleeve which terminates near the lowermost outer surface area of the stripper rubber, thereby providing a replaceable wear surface at the lower marginal end of said washpipe; and, a plurality of fingers hingedly affixed to said stripper mount member, each of the fingers extend from said large annular upper end and into said inner annular body; said fingers have marginal edges which overlap one another and thereby form a continuous reinforcement for 360° about the stripper rubber.

7. The rotating blowout preventor of claim 6 wherein said rotating head assembly is rotatably mounted to said main body by journal means located externally of said washpipe, with the upper end of the rotating head assembly extending above said washpipe; a seat formed at the upper marginal end of said rotating head assembly, the upper marginal end of said stripper assembly being received by said seat; and clamp means circumferentially extending about and holding the upper marginal end of said mount member to the remaining part of the rotating head assembly.

8. In a rotating blowout preventor having a main body which includes a mounting means at the lower end thereof by which the preventor can be attached to the upper end of the casing, a lateral outlet at a sidewall thereof; an upstanding washpipe located within said main body, said washpipe has a circumferentially extending surface formed on the interior thereof, a rotating head assembly rotatably mounted respective to said main body; the combination with said rotating head assembly of a stripper assembly;

said stripper assembly includes a metal mount member having a stripper rubber attached to the lower end thereof, a rotating seal means affixed to said stripper assembly for sealingly engaging the wall surface of the washpipe, an axial passageway formed through said main body and stripper assembly through which a rotating member can be received;

said stripper rubber has a large annular upper end attached to said mount member, and concentrically arranged, spaced lower marginal annular ends;

said lower annular ends are comprised of an inner annular body and an outer annular body made integral with respect to said large annular end and separated from one another by a downwardly opening annular recess;

said inner annular body has an axial passageway formed therethrough for sealingly engaging a rotating member; said outer annular member has an outer circumferentially extending surface which sealingly engages a circumferentially extending inner surface area of the washpipe;

a cylindrical control sleeve vulcanized within said outer annular member, said control sleeve is concentrically arranged respective to the washpipe and the axial passageway, said control sleeve extends from said large annular upper end into said outer annular body for reinforcing the outer surface of said outer annular member to thereby improve the seal effected by the contact area between the inner surface of the washpipe and the outer annular body of the stripper rubber.

9. The combination of claim 8 wherein said annular recess includes an upwardly and outwardly inclined first wall which forms the lower outer marginal end of said inner annular body, an upwardly and inwardly inclined second wall which forms the lower inner marginal end of said outer annular body, and a sloped third wall which lies at an obtuse angle respective to said first wall and at an acute angle respective to said second wall so that debris which intersects either of said first, second, or third wall surfaces are deflected in such a manner to minimize the entrance thereof into the annulus formed between the stripper rubber assembly and the washpipe.

10. The combination of claim 9 wherein said control sleeve is comprised of a plurality of reinforcing cords which extend 360° about the axial passageway.

11. The combination of claim 9 wherein the upper marginal end of said stripper rubber has an outer surface area which enlarges in diameter in a downward direction to form said outer annular area, the inside surface area of said washpipe terminates at the lowermost outer surface area of the outer annular area, thereby providing a rotating barrier at the lowermost end of said washpipe; a wear sleeve removably positioned adjacent to the lower end of the outer annular area; and, a plurality of fingers hingedly affixed to said stripper mount member, each of the fingers extend from said large annular upper end and into said inner annular body; said fingers have marginal edges which overlap one another and thereby form a continuous reinforcement for 360° about the stripper rubber.

12. The combination of claim 11 wherein said first wall surface is inclined at a small angle respective to the central axis of the stripper assembly, and said third wall surface is inclined at a greater angle relative to the first wall; and, said control sleeve is a metal cylinder having perforations formed therein for increasing the bonding strength between the control sleeve and the stripper rubber.

13. The combination of claim 8 wherein said rotating head assembly is rotatably mounted to said main body by journal means located externally of said washpipe, at least part of the rotating head assembly extends above said washpipe; a seat formed within the upper marginal end of said rotating assembly, the outer upper marginal end of said stripper assembly is received on said seat; and clamp means circumferentially extending about and holding the upper marginal end of said mount member to the remaining part of the rotating head assembly.

14. The combination of claim 8 wherein the upper marginal end of said stripper rubber has an outer surface area which enlarges in diameter in a downward direction to form the exterior surface of said outer annular member; the inside surface area of said washpipe terminates adjacent to the lowermost outer surface area of the outer annular member, thereby providing a rotating seal at the lowermost end of said washpipe;

a removable liner affixed to said washpipe at a location adjacent the outer annular member;

said first wall surface is inclined at a small angle respective to the central axis of the stripper assembly, while said second wall surface is inclined at a greater angle respective to the first wall.

15. The combination of claim 14 wherein said rotating head assembly is rotatably mounted to said main body by journal means located externally of said washpipe, with the rotating head assembly extending above said washpipe; a seat formed at the upper marginal end of said rotating head assembly, the upper marginal end of said stripper assembly being received by said seat; and clamp means circumferentially extending about and holding the upper marginal end of said stripper assembly to the rotating head assembly.

16. In a rotating blowout preventor having a main body which includes a mounting means at the lower end thereof by which the preventor can be attached to the upper end of a casing, an axial passageway formed through the main body, and a lateral outlet at a sidewall thereof; an upstanding washpipe located within said main body, said washpipe has a circumferentially extending surface formed on the interior thereof, a rotating head assembly rotatably mounted respective to said main body; the combination with said rotating head assembly of a stripper assembly;

said stripper assembly includes a metal mount member having a stripper rubber attached to the lower end thereof, a rotating seal means affixed to said stripper assembly for sealingly engaging the wall surface of the washpipe, an axial passageway formed through said stripper assembly in axially aligned relationship respective to the axial passageway of the main body through which a rotating member can be received;

said stripper rubber has a large annular upper end attached to said mount member, and concentrically arranged, spaced, lower marginal annular ends;

said lower annular ends are comprised of an inner annular body and an outer annular body made integral with respect to said large annular end and separated from one another by a downwardly opening annular recess;

said axial passageway formed through said stripper assembly includes an axial passageway formed through said inner annular body for sealingly engaging a rotating member; said seal means includes an outer circumferentially extending surface formed on said outer annular member which sealingly engages the lower inside marginal ends of the washpipe;

a control sleeve mounted within said stripper rubber for providing reinforcement thereto and thereby reduce distortion of said outer annular body, said control sleeve is concentrically arranged respective to the washpipe and extends 360° about the axis of the axial passageway; said control sleeve includes an upper marginal end embedded within said large annular upper end and a lower marginal end embedded within said outer annular body.

17. The combination of claim 16 wherein said rotating head assembly is rotatably mounted to said main body by journal means located externally of said washpipe, with the rotating assembly extending above said washpipe; a seat formed within the upper marginal end of said rotating assembly, the outer upper marginal end of said stripper assembly being received on said seat; and clamp means arranged to circumferentially extend about and hold the upper marginal end of said mount member to the remaining part of the rotating head assembly; and, a plurality of fingers hingedly affixed to said stripper mount member, each of the fingers extend from said large annular upper end and into said inner annular body; said fingers have marginal edges which overlap one another and thereby form a continuous reinforcement for 360° about the stripper rubber.

* * * * *